US006299455B1

(12) United States Patent
Dong

(10) Patent No.: US 6,299,455 B1
(45) Date of Patent: Oct. 9, 2001

(54) STACKED ELECTRICAL CARD CONNECTOR ASSEMBLY

(75) Inventor: Shun-Chi Dong, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/464,289

(22) Filed: Dec. 15, 1999

(51) Int. Cl.[7] ..... H01R 12/00
(52) U.S. Cl. ..... 439/59; 439/79; 439/541.5
(58) Field of Search ..... 439/64, 59, 541.5, 439/79

(56) References Cited

U.S. PATENT DOCUMENTS 5,290,174 * 3/1994 Woratyla et al. ..... 439/59
5,636,999 * 6/1997 Hirai et al. ..... 439/79
5,688,130 * 11/1997 Huang ..... 439/79
5,775,923 * 7/1998 Tomioka ..... 439/79

* cited by examiner

*Primary Examiner*—Renee Luebke
(74) *Attorney, Agent, or Firm*—Wei Te Chung

(57) ABSTRACT

A stacked electrical card connector assembly comprises upper and lower headers, a number of terminals extending through the headers, upper and lower grounding plates respectively attached to the upper and lower headers, and a transition device attached to the headers and mounted to a PCB. Each grounding plate comprises a pair of grounding legs downwardly extending from a front edge thereof. The transition device includes male and female transition connectors connected with each other. The male transition connector defines two rows of passageways for extension of the terminals retained in the headers, and a pair of receiving holes respectively on opposite ends of each row of the passageways for extension of the grounding legs therethrough. The female transition connector comprises two rows of signal contacts for connecting with the terminals retained in the headers, and a pair of grounding contacts on each end of each row of the signal contacts for engaging the corresponding grounding leg.

6 Claims, 5 Drawing Sheets

STACKED ELECTRICAL CARD CONNECTOR ASSEMBLY

BACKGROUND OF THE INVENTION

1. Field of the Invention

The present invention relates to an electrical card connector assembly, and particularly to a stacked electrical card connector assembly for ensuring reliable grounding capabilities thereof. In addition, the assembly features a low-profile structure which benefits reduced space on a printed circuit board (PCB) where the connector assembly is mounted.

2. Description of Prior Art

Most electrical cards and electrical card connectors conform to the standards of PCMCIA (Personal Computer Memory Card International Association). However, as both the requirements on capacity and speed of signal transmission increase, the quality of signal transmission is more vulnerable to electrostatic interference which may adversely affect the quality of signal transmission. To overcome the above-mentioned deficiency, a grounding plate for electrostatic discharge (ESD) is commonly assembled to the electrical card connector for effectively discharging the ESD thereby ensuring reliable signal transmission.

A stacked electrical card connector assembly is disclosed in a co-pending application, Ser. No. 09/421,441, filed on Oct. 19, 1999, assigned to the same assignee as the instant invention, and is incorporated herein for reference. The stacked card connector assembly comprises upper and lower grounding plates respectively attached to upper and lower headers. The lower grounding plate has a plurality of spring fingers downwardly extending into corresponding passageways in a male transition connector to contact corresponding grounding strips in a female transition connector connected with the male transition connector and soldered to grounding pads of a PCB. The upper grounding plate has a plurality of forwardly and downwardly extending spring arms for contacting the lower grounding plate. Thus, a grounding path is established between electrical cards inserted into the stacked electrical card connector assembly and the PCB via the upper and lower grounding plates and the grounding strips in the female transition connector.

However, the length of the male transition connector is significantly increased since one row of the passageways for receiving the spring fingers of the lower grounding plate is defined between two rows of terminal-receiving passageways. Thus, the entire length of the stacked electrical connector assembly is increased which needs more space to accommodate it. In some applications, especially in the notebook computer application, there is no room for the additional length. Furthermore, the spring fingers of the lower grounding plate are soldered to the corresponding grounding strips in the female transition connector to ensure a reliable contact therebetween. Therefore, if the spring fingers are improperly soldered to the corresponding grounding strips, it will be difficult to conduct a remedy and maintenance.

The present invention is directed to provide a low-profile stacked electrical connector assembly which can be used for different applications.

SUMMARY OF THE INVENTION

Accordingly, one object of the present invention is to provide a stacked electrical card connector assembly having reduced length thereby conserving the occupied space on a PCB where the connector assembly is mounted.

Another object of the present invention is to provide a stacked electrical card connector assembly having improved upper and lower grounding plates, and improved male and female transition connectors with little modification to the conventional designs thereof.

In order to achieve the objects set forth, a stacked electrical card connector assembly in accordance with the present invention comprises upper and lower headers stacked together, a plurality of terminals extending through the headers, upper and lower grounding plates respectively attached to the upper and lower headers, and a transition device attached to the headers and mounted on a PCB. Each grounding plate comprises a plurality of spring fingers for contacting grounding patterns on an inserted electrical card and a pair of grounding legs downwardly extending from a front edge thereof. The transition device includes male and female transition connectors connectable with each other. The male transition connector defines two rows of passageways for extension of connecting ends of the terminals retained in the headers, and a pair of receiving holes respectively in opposite ends of each row of the passageways for extension of the corresponding grounding legs therethrough. The female transition connector comprises two rows of signal contacts for connecting with the connecting ends of the terminals in the headers, and two grounding contacts on each end of each row of the signal contacts for engaging a corresponding grounding leg.

With such a design, a compact transition device is obtained with little modification to the conventional design thereof thereby conserving the occupied space on the PCB, and reliable grounding capabilities are also ensured.

Other objects, advantages and novel features of the invention will become more apparent from the following detailed description when taken in conjunction with the accompanying drawings.

DETAILED DESCRIPTION OF THE INVENTION

Figure 1:
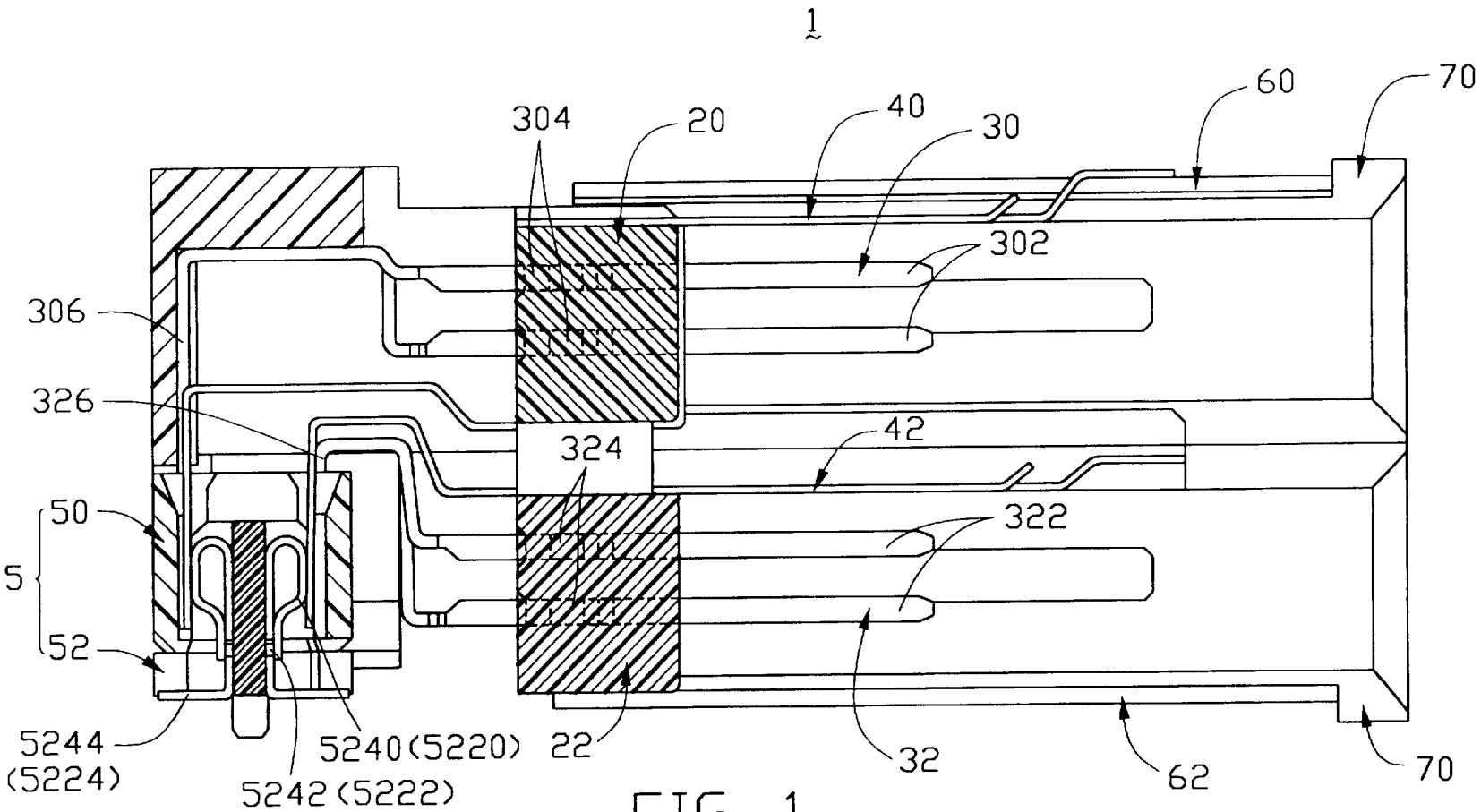
FIG. 1 is a cross-sectional view of a stacked electrical card connector assembly in accordance with the present invention.

Reference will now be made to the drawing figures to describe the present invention in detail.

Referring to FIG. 1, a stacked electrical card connector assembly 1 in accordance with the present invention comprises an upper header 20 and a lower header 22 stacked on each other, a plurality of terminals 30, 32 respectively retained in the upper and lower headers 20, 22, upper and lower grounding plates 40, 42 respectively attached to the upper and lower headers 20, 22, and a transition device 5 attached to the headers 20, 22 and mounted on a PCB (not shown). The present invention further comprises top and bottom shields 60, 62 for providing EMI/RFI shielding for the terminals 30, 32, and a card ejection mechanism 70 mounted on one side of each shield 60, 62 for ejecting an inserted electrical card (not shown) from the stacked card connector assembly 1. Since the structures of the top and bottom shields 60, 62 and the card ejection mechanism 70 are well known to one of ordinary skill in the art, a detailed description thereof will be omitted hereinafter.

Figure 2:
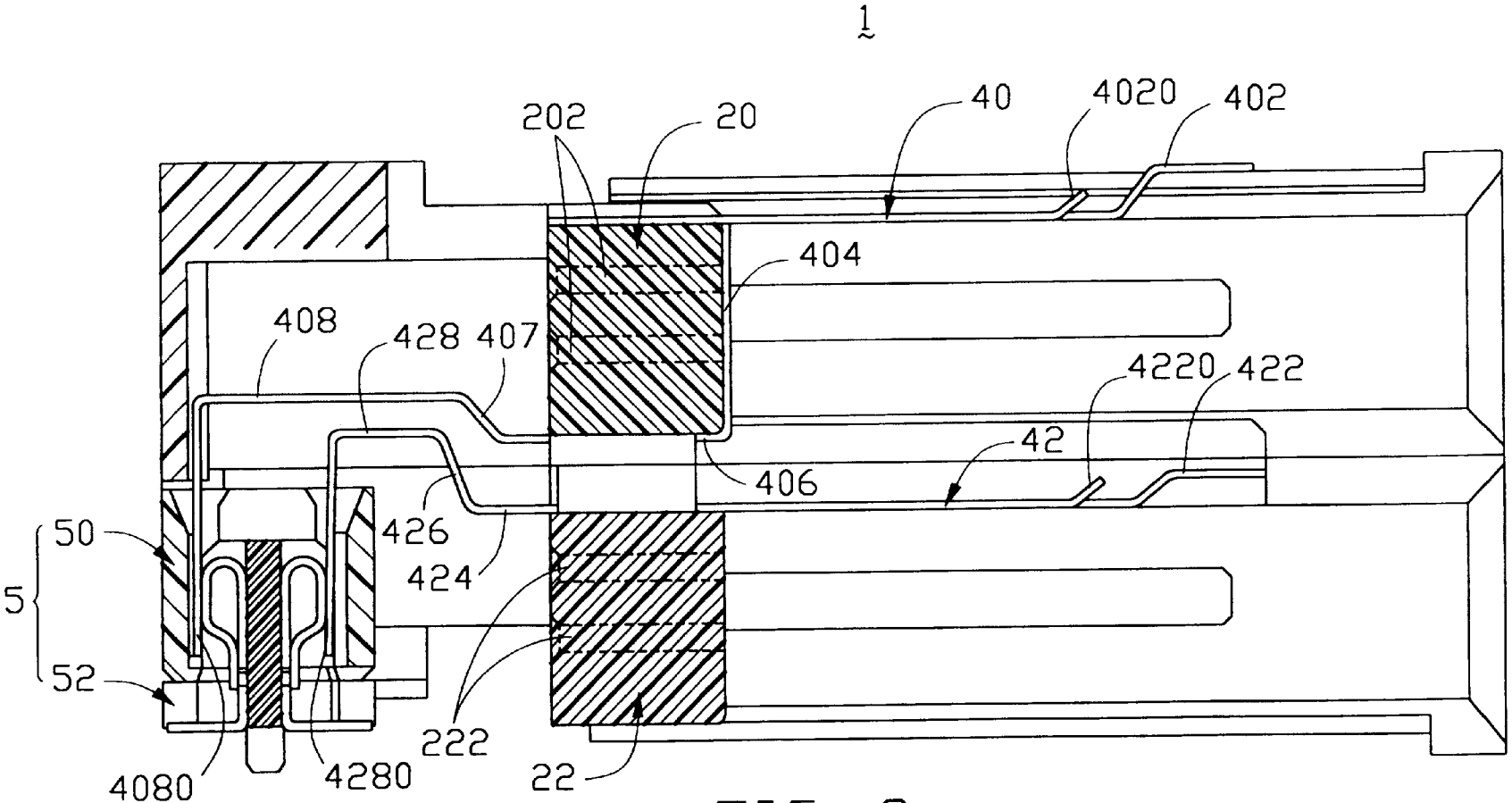
FIG. 2 is a view similar to FIG. 1 with terminals removed therefrom for clarity.

Also referring to FIG. 2, each header 20, 22 defines two rows of terminal-receiving passageways 202, 222 (shown in phantom) for receiving the terminals 30, 32. In this embodiment, four rows of the terminals 30, 32 are shown comprising two sets, one set of terminals 30 in the upper header 20 and the other set of terminals 32 in the lower header 22. Each terminal 30, 32 includes a rear mating end 302, 322 for mating with a corresponding mating terminal of an inserted electrical card (not shown), an intermediate retention portion 304, 324 (shown in phantom) interferentially retained in the header 20, 22, and a front connecting end 306, 326 opposite and perpendicular to the mating end 302, 322 for being inserted into the transition device 5. The connecting ends 306, 326 of two rows of each set are in the same vertical plane.

Figure 3:
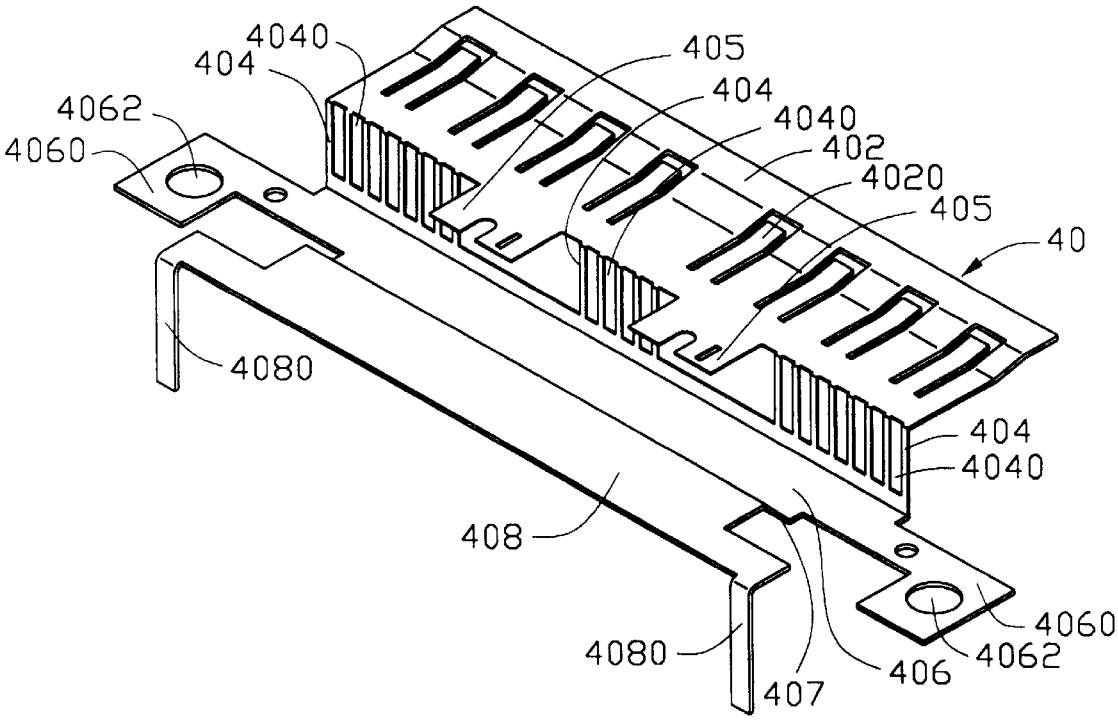
FIG. 3 is a perspective view of an upper grounding plate of the present invention.

Also referring to FIG. 3, the upper grounding plate 40 includes an upwardly inclined first rear portion 402 with a plurality of first spring fingers 4020 stamped therein for contacting corresponding grounding patterns on the inserted electrical card. Three middle portions 404 perpendicularly extend downward from a front edge of the first rear portion 402 for being attached to a rear side of the upper header 20. A plurality of elongate slots 4040 is defined in each middle portion 404 for extension of the mating ends 302 of the terminals 30 extending rearward from the upper header 20. A pair of fixing portions 405 forwardly extends from the first rear portion 402 between the middle portions 404 for engaging the upper header 20. An elongate portion 406 perpendicularly extends forward from and connects the middle portions 404 for being attached to a bottom side of the upper header 20. A first positioning tab 4060 is provided on each end of the elongate portion 406 with a first opening 4062 defined therein. A first extension 408 is connected with the elongate portion 406 via an upwardly inclined first transition portion 407. The first extension 408 has a pair of first grounding legs 4080 respectively extending downward from a front edge proximate opposite ends thereof.

Figure 4:
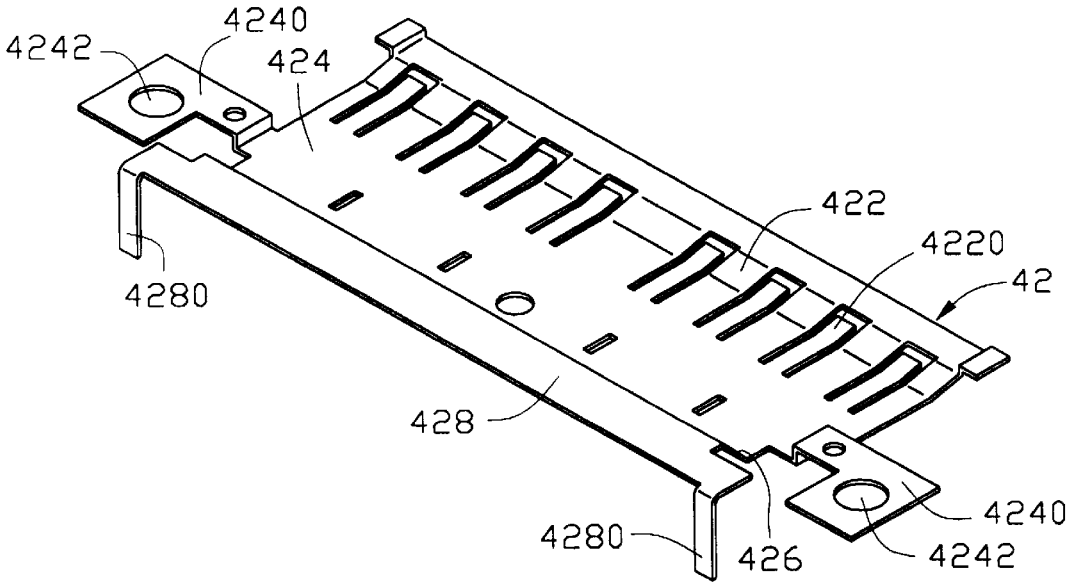
FIG. 4 is a perspective view of a lower grounding plate of the present invention.

As shown in FIG. 4, the lower grounding plate 42 includes an upwardly inclined second rear portion 422 with a plurality of second spring fingers 4220 stamped therein for contacting the inserted electrical card. A planar middle portion 424 forwardly extends from the second rear portion 422. A second positioning tab 4240 extends from each lateral edge of the planar middle portion 424. A second opening 4242 is defined in each second positioning tab 4240 in alignment with the corresponding first opening 4062 of the upper grounding plate 40 for extension of a securing member (not shown) therethrough to secure the grounding plates 40, 42 and the headers 20, 22 together. A second extension 428 is connected with the planar middle portion 424 via an upwardly inclined second transition portion 426. The second extension 428 has a pair of second grounding legs 4280 respectively extends downward from a front edge proximate opposite ends thereof.

Figure 5:
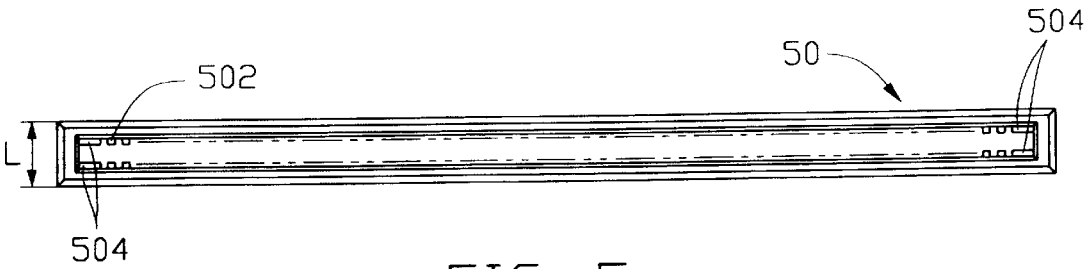
FIG. 5 is a top plan view of a male transition connector of the present invention.

Referring back to FIG. 1, the transition device 5 is attached to the headers 20, 22 and includes a male transition connector 50 and a female transition connector 52 connected with each other. As illustrated in FIG. 5, the male transition connector 50 defines two rows of passageways 502 for extension of the connecting ends 306, 326 of the terminals 30, 32 therethrough. A pair of receiving holes 504 is respectively defined in opposite ends of each row of the passageways 502. Each receiving hole 504 has a width larger than that of two passageways 502 for extension of a corresponding grounding leg 4080, 4280 of the grounding plate 40, 42.

Figure 6:
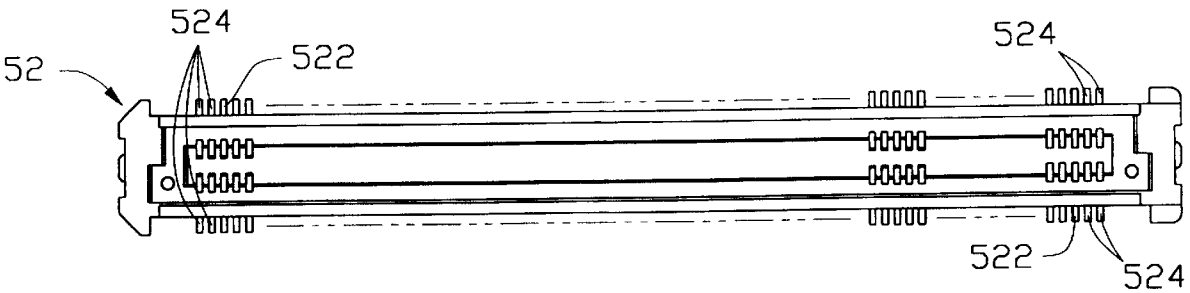
FIG. 6 is a top plan view of a female transition connector of the present invention.
Figure 7:
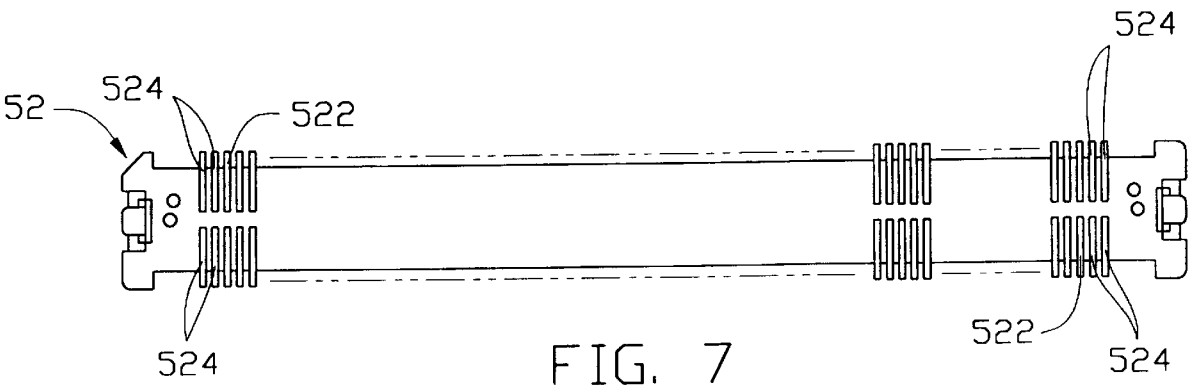
FIG. 7 is a bottom plan view of the female transition connector of FIG.6.

As shown in FIGS. 6 and 7, the female transition connector 52 of the transition device 5 comprises two rows of signal contacts 522. Each row of the signal contacts 522 further comprises a pair of grounding contacts 524 on each end thereof corresponding to the receiving hole 504 in the male transition connector 50. The signal contacts 522 and the grounding contacts 524 are identical in structure. The number of the signal contacts 522 is equal to that of the passageways 502 of the male transition connector 50. Also referring to FIG. 1, each terminal 522, 524 includes a curved mating portion 5220, 5240, an intermediate retention portion 5222, 5242 interferentially retained in the female transition connector 52, and a horizontally extending tail portion 5224, 5244 for being soldered to the PCB using SMT (surface mount technology). The curved mating portions 5220 and 5240 are adapted for respectively connecting with corresponding connecting ends 306, 326 of the terminals 30, 32 and the grounding legs 4080, 4280 of the grounding plates 40, 42. In this embodiment, each pair of the grounding contacts 524 engages one grounding leg 4080, 4280.

In assembly, the male transition connector 50 of the transition device 5 is attached to the headers 20, 22. The two rows of the connecting ends 306, 326 of the terminals 30, 32 are inserted into the passageways 502 of the male transition connector 50. The upper and lower grounding plates 40, 42 are respectively attached to the upper and lower headers 20, 22 with the grounding legs 4080, 4280 thereof extending into the corresponding receiving holes 504 of the male transition connector 50. The male transition connector 50 then mates with the female transition connector 52 whereby the connecting ends 306, 326 of the terminals 30, 32 connect with the curved mating portions 5220 of the corresponding signal contacts 522 and the grounding legs 4080, 4280 of the grounding plates 40, 42 engage the mating portions 5240 of the corresponding grounding contacts 524. The top and bottom shields 60, 62 with the card ejection mechanisms 70 mounted thereon are finally attached to the headers 20, 22. Thus, an electrical interconnection between the inserted electrical card and the PCB is established via the terminals 30, 32 and the signal contacts 522 of the female transition connector 52 which are soldered to circuitry on the PCB. A grounding path between the inserted electrical card and the PCB is also established via the grounding legs 4080, 4280 of the grounding plates 40, 42 and the grounding contacts 524 of the female transition connector 52 which are soldered to corresponding grounding patterns on the PCB.

As illustrated in FIG. 5, the length L of the male transition connector 50 in accordance with the present invention is significantly reduced thereby conserving occupied space on the PCB. Furthermore, due to the provision of the grounding legs 4080, 4280 of the grounding plates 40, 42, the receiving holes 504 in the male transition connector 50 and the grounding contacts 524 in the female transition connector 52, reliable grounding capabilities are ensured and maintenance is also facilitated.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. A stacked electrical card connector assembly mounted on a printed circuit board for interconnecting inserted electrical cards with the printed circuit board, comprising:

first and second headers stacked together;

a plurality of rows of first and second terminals respectively extending through the first and second headers, each terminal having a downwardly extending connecting end;

a first grounding plate attached to the first header and including a pair of first grounding legs downwardly extending therefrom in alignment with the connecting ends of the first terminals;

a second grounding plate attached to the second header and including a pair of second grounding legs downwardly extending therefrom in alignment with the connecting ends of the second terminals;

a male transition connector defining two rows of passageways to receive the connecting ends of the terminals and a pair of receiving holes respectively on opposite ends of and in alignment with each row of the passageways to receive corresponding grounding legs; and a female transition connector connected with the male transition connector and mounted on a printed circuit board, the female transition connector comprising two rows of signal contacts for connecting with the connecting ends of the terminals and a pair of grounding contacts situated at each of two distal ends of each row of the signal contacts for contacting a corresponding grounding leg; wherein each grounding leg has a width substantially equal to that of the receiving hole of the male transition connector and larger than that of a corresponding pair of grounding contacts of the female transition connector.

2. The stacked electrical card connector assembly as described in claim 1, wherein the first and second grounding legs respectively extend from front edges of the first and second grounding plates.

3. The stacked electrical card connector assembly as described in claim 1, wherein the grounding contacts and the signal contacts of the female transition connector are identical in structure.

4. The stacked electrical card connector assembly as described in claim 1, wherein each of the first and second grounding plates has a plurality of spring fingers for contacting an inserted electrical card.

5. A stacked electrical connector assembly comprising:

first insulative header stacked onto a second insulative header;

a plurality of first and second terminals respectively extending through the first and second headers, each of said terminals defining a downwardly extending connecting end, the connecting ends of the first terminals being arranged in one line and the connecting ends of the second terminals being arranged in another line parallel to said one line;

a first grounding plate attached to the first header with a first grounding leg extending downwardly therefrom and beside the connecting end of the outermost one of said first terminals;

a second grounding plate attached to the second header with a second grounding leg extending downwardly therefrom and beside the connecting end of the outermost one of said second terminals; and a female transition connector receiving two rows of contacts therein, each row of contacts including a pair of grounding contacts at one end thereof;

wherein one row of contacts mechanically and electrically engage both the connecting ends of the first terminals and the first grounding leg, and the other row of contacts mechanically and electrically engage both the connecting ends of the second terminals and the second grounding leg;

wherein each grounding leg of the first and second grounding plates engages with a corresponding pair of grounding contacts of the female transition connector and has a width larger than that of the corresponding pair of grounding contacts.

6. A stacked electrical card connector assembly comprising:

upper and lower headers stacked with each other;

a plurality of upper terminals extending through the upper header with connecting ends extending therefrom;

a plurality of lower terminals extending through the lower header with connecting ends extending therefrom;

an upper grounding plate attached to the upper header, said upper grounding plate including vertical middle portions, a generally horizontal upper extension, and an upper grounding leg downwardly extending therefrom;

a second grounding plate attached to the second header with a generally horizontal lower extension and a lower grounding leg downwardly extending therefrom; and a female transition connector including two rows of contacts; wherein the upper extension and the lower extension are spaced from each other and are both between the connecting ends of the upper terminals and those of the lower terminals, and the upper grounding leg engages at least one contact in one row of contacts which are farther away from the headers than the other row of contacts, of which one is engaged with the lower grounding leg.

* * * * *